US006210232B1

(12) United States Patent
Lai et al.

(10) Patent No.: US 6,210,232 B1
(45) Date of Patent: Apr. 3, 2001

(54) ELECTRICAL CONNECTOR WITH POLYSWITCH

(75) Inventors: Chin-Yi Lai, Tu-Chen; Jen-Hou Chang, Yung-Ho, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/371,620

(22) Filed: Aug. 10, 1999

(30) Foreign Application Priority Data

May 15, 1999 (TW) ..... 88207776

(51) Int. Cl.[7] ..... H01R 13/66; H01R 33/945
(52) U.S. Cl. ..... 439/620
(58) Field of Search ..... 439/620, 621, 439/90, 91, 607

(56) References Cited

U.S. PATENT DOCUMENTS 4,820,203 * 4/1989 Figone ..... 439/620
4,862,311 * 8/1989 Rust et al. ..... 361/91
5,224,878 * 7/1993 Lurie et al. ..... 439/620
5,674,085 * 10/1997 Davis et al. ..... 439/188
5,865,648 * 2/1999 Clyatt, III ..... 439/620
5,928,035 * 7/1999 Jankowsky et al. ..... 439/607

* cited by examiner

*Primary Examiner*—Lincoln Donovan
*Assistant Examiner*—Brian S. Webb
(74) *Attorney, Agent, or Firm*—Wei Te Chung

(57) ABSTRACT

An electrical connector comprises an insulative body defining a number of passageways therein, a shield enclosing the body, a number of contacts received in corresponding passageways, and a polyswitch for preventing excessive current from damaging the connector. One of the contacts consists of first and second contact members. The first contact member is adapted for mating with a mating contact of a complementary connector and the second contact member is adapted for being soldered to a circuit board. The polyswitch is retained in a cavity formed in the insulative body and is securely sandwiched between the first and second contact members.

7 Claims, 4 Drawing Sheets

ELECTRICAL CONNECTOR WITH POLYSWITCH

BACKGROUND OF THE INVENTION

1. Field of the Invention

The present invention relates to an electrical connector, and particularly to an electrical connector with a polyswitch retained therein for preventing excessive current from damaging the connector.

2. Description of Prior Art

A resettable device is commonly used to protect against a current exceeding a rated operational value anticipated by an electronic device such as a monitor, a keyboard and a stand-alone hub. The resettable device may take various forms such as a fuse, a bimetal, a ceramic PTC device or a polymeric PTC device which can be a polyswitch. To prevent excessive current from damaging or destroying an electronic system such as a computer, the resettable device is conventionally mounted on a mother board and occupies a significant amount of space thereon. Since the efficient use of space on the mother board is extremely important due to the trend of miniaturization, removing the resettable device from the mother board to reduce the occupied space thereon is requisite.

Therefore, a long and unfilled need exists in the prior art for removing the resettable device from the mother board in promotion of miniaturization.

SUMMARY OF THE INVENTION

Accordingly, one object of the present invention is to provide an electrical connector with a polyswitch retained therein for reducing occupied space on a mother board and for preventing excessive current from damaging an electronic system thereby ensuring reliable signal transmission.

Another object of the present invention is to provide a method for simply and securely retaining a polyswitch in an electrical connector by means of a pair of contact members.

In order to achieve the objects set forth, an electrical connector in accordance with a preferred embodiment of the present invention comprises an insulative body defining a plurality of contact-receiving passageways therein, a shield enclosing the insulative body, a plurality of contacts received in the corresponding passageways of the insulative body, and a polyswitch retained in the insulative body. The plurality of contacts comprises a contact consisting of first and second contact members. The first contact member is adapted for mating with a corresponding mating contact of a complementary connector, and the second contact member is adapted for being soldered to a circuit board.

The polyswitch sandwiched between the first and second contact members is made from a polymer composition containing polymer materials of high molecular weight. Under normal temperature conditions, the polyswitch acts as a conductor, whereas under high temperature conditions, the polyswitch acts as an insulator. Accordingly, when a current passing through the first contact member due to connection with the mating contact is within the rated operational current of an electronic system, the polyswitch acts as a conductor to allow the current to pass through the second contact member to form a closed circuit. When the current passing through the first contact member exceeds the rated operational current, the polyswitch acts as an insulator and creates an open circuit thereby preventing damage to the electronic system.

A transverse T-shaped cavity is formed in the insulative body for retaining the first and second contact members and the polyswitch. The polyswitch is sandwiched between the first and second contact members thereby being securely retained in the insulative body instead of being mounted on a mother board and occupying a significant amount of space thereon.

Other objects, advantages and novel features of the invention will become more apparent from the following detailed description when taken in conjunction with the accompanying drawings.

DETAILED DESCRIPTION OF THE INVENTION

Figure 1:
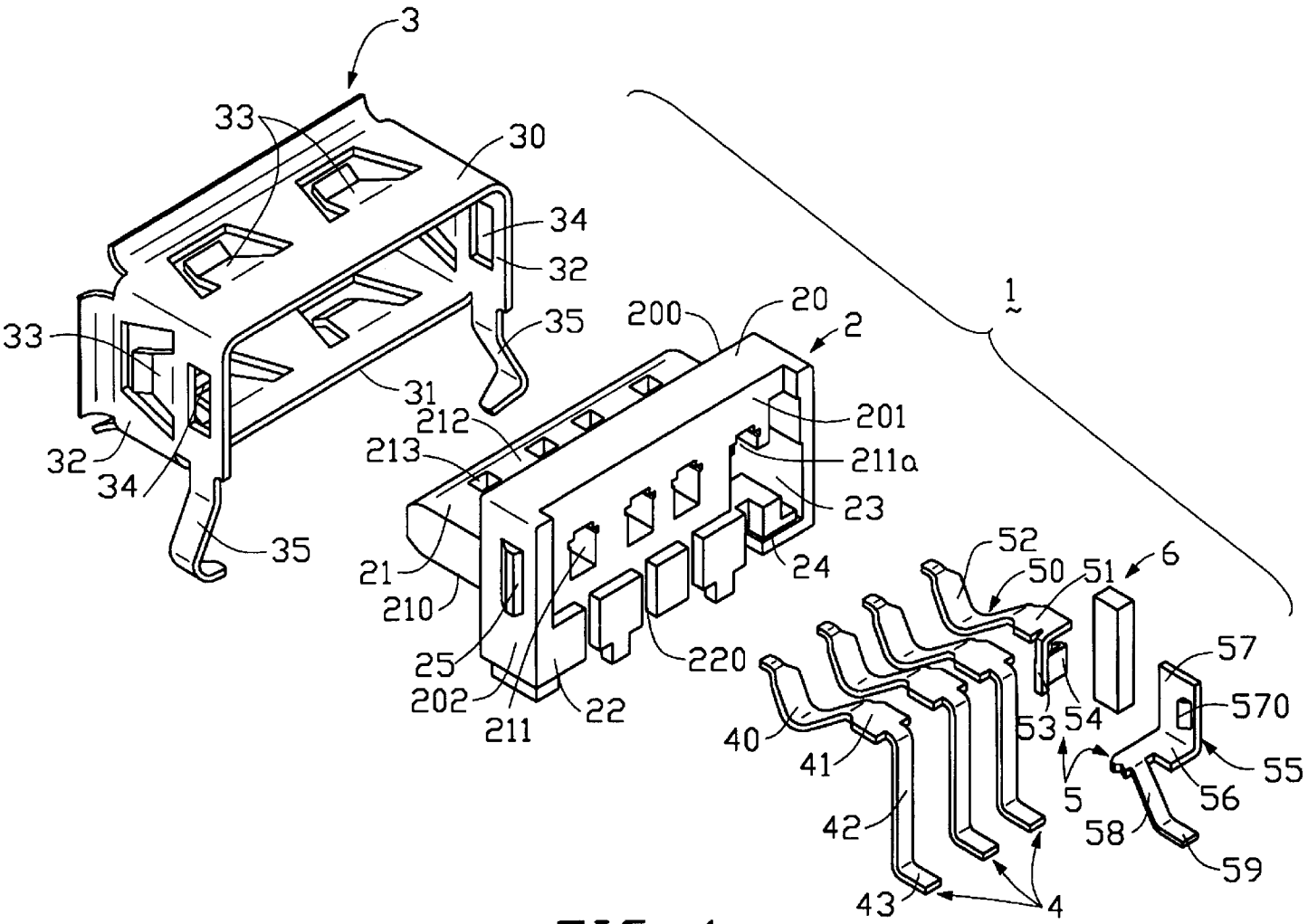
FIG. 1 is an exploded perspective view of an electrical connector and a polyswitch in accordance with a preferred embodiment of the present invention.

Reference will now be made in detail to a preferred embodiment of the present invention in conjunction with the drawings. Referring first to FIG. 1, an electrical connector 1 comprises an insulative body 2, a shield 3, a plurality of contacts 4, 5, and a polyswitch 6. The insulative body 2 comprises a main body 20 defining a mating surface 200 and an opposite assembly surface 201. A mating portion 21 projects from the mating surface 200 for mating with a complementary electrical connector (not shown). A plurality of recesses (not shown) corresponding to the number of the contacts 4, 5 is formed in a bottom surface 210 of the mating portion 21. The recesses are in communication with corresponding openings 211, 211*a* defined through the main body 20 and corresponding through holes 213 formed in a top surface 212 of the mating portion 21. The openings 211, 211*a*, the recesses and the through holes 213 together define a plurality of contact-receiving passageways (not labeled) for receiving the contacts 4, 5. A plurality of protrusions 22 is formed on the assembly surface 201 adjacent to a bottom edge of the main body 20. A groove 220 is defined between each pair of adjacent protrusions 22. A transverse T-shaped receiving cavity 23 is defined in the main body 20 in communication with the opening 211*a* with the adjacent protrusion 22 partially cut away. An L-shaped slot 24 is disposed in the partially cut protrusion 22 in communication with the adjacent groove 220 and the receiving cavity 23. Extending from opposite side surfaces 202 of the main body 20 is a pair of bosses 25.

The shield 3 is adapted for enclosing the insulative body 2 and shielding the contacts 4, 5 received in the body 2 from EMI (electromagnetic interference). The shield 3 comprises an upper shielding plate 30, a lower shielding plate 31 and a pair of opposite side shielding plates 32. Resilient tangs 33 are stamped from the shieldingplates 30, 31, 32 forengagingwiththecomplementaryconnector. A hole 34 is disposed in each side shielding plate 32 adjacent to the corresponding tang 33 for engaging with the corresponding boss 25 of the insulative body 2 thereby securely enclosing the insulative body 2. A pair of legs 35 downwardly extends from bottom edges of the side shielding plates 32 below the corresponding holes 34 for insertion into corresponding holes in a printed circuit board (not shown) thereby mounting the connector 1 thereon.

Each contact 4 includes a curved contact section 40 for mating with a corresponding mating contact of the complementary connector, a retention section 41 for interferentially engaging with the corresponding openings 211 of the insulative body 2, a supporting section 42 approximately perpendicularly extending from the retention section 41, and a horizontal solder section 43 for being soldered to solder pads on the printed circuit board.

The contact 5 consists of a first contact member 50 and a second contact member 55. The first contact member 50 comprises a first retention section 51 for interferentially engaging with the opening 211*a* of the insulative body 2, a curved first contact section 52 forwardly extending from the first retention section 51 for mating with the corresponding mating contact of the complementary connector, a first abutment section 53 perpendicularly extending from the retention section 51, and a tongue section 54 perpendicularly extending from the abutment section 53. The second contact member 55 comprises a second retention section 56, a second abutment section 57 upwardly extending from the second retention section 56 with a projection 570 formed thereon, a second supporting section 58 downwardly extending from the retention section 56, and a horizontal second solder section 59 for being soldered to the circuit board.

The polyswitch 6 having a rectangular shape is received in the cavity 23 of the insulative body 2 and is sandwiched between the first and second contact members 50, 55. The polyswitch 6 is provided for preventing excessive current from passing through the connector 1 which may damage or destroy an electronic system due to overheating. To complement such a function, the polyswitch 6 is made from a conductive polymer composition containing polymer materials of high molecular weight. Under normal temperature conditions, the polyswitch 6 acts as a conductor, while under high temperature conditions the polyswitch 6 acts as an insulator. The critical temperature of the polyswitch 6 is adjustable by changing the composition thereof.

Figure 2:
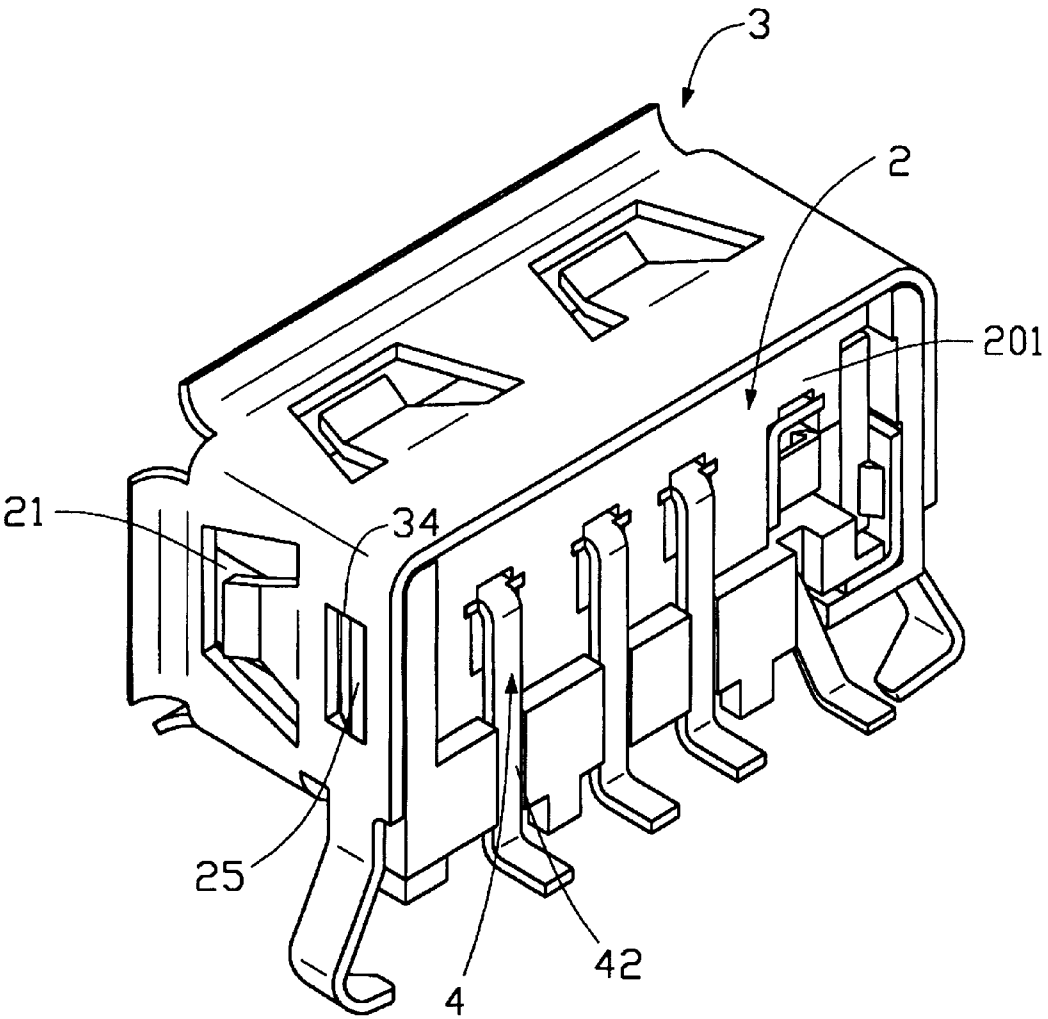
FIG. 2 is an assembled view of FIG. 1.

Also referring to FIG. 2, in assembly, each contact 4 is first received in the insulative body 2 with the contact section 40 thereof extending through the corresponding opening 211 of the main body 20 into the through hole 213 of the mating portion 21. The retention section 41 of each contact 4 interferentially engages with the corresponding opening 211 of the main body 20. The supporting section 42 of each contact 4 is retained in the corresponding groove 220. Thus, the contacts 4 are securely retained in the insulative body 2. The shield 3 is then assembled to the insulative body 2 in a direction facing the mating portion 21 by engagement between the bosses 25 of the insulative body 2 and the corresponding holes 34 of the shield 3.

Figure 3:
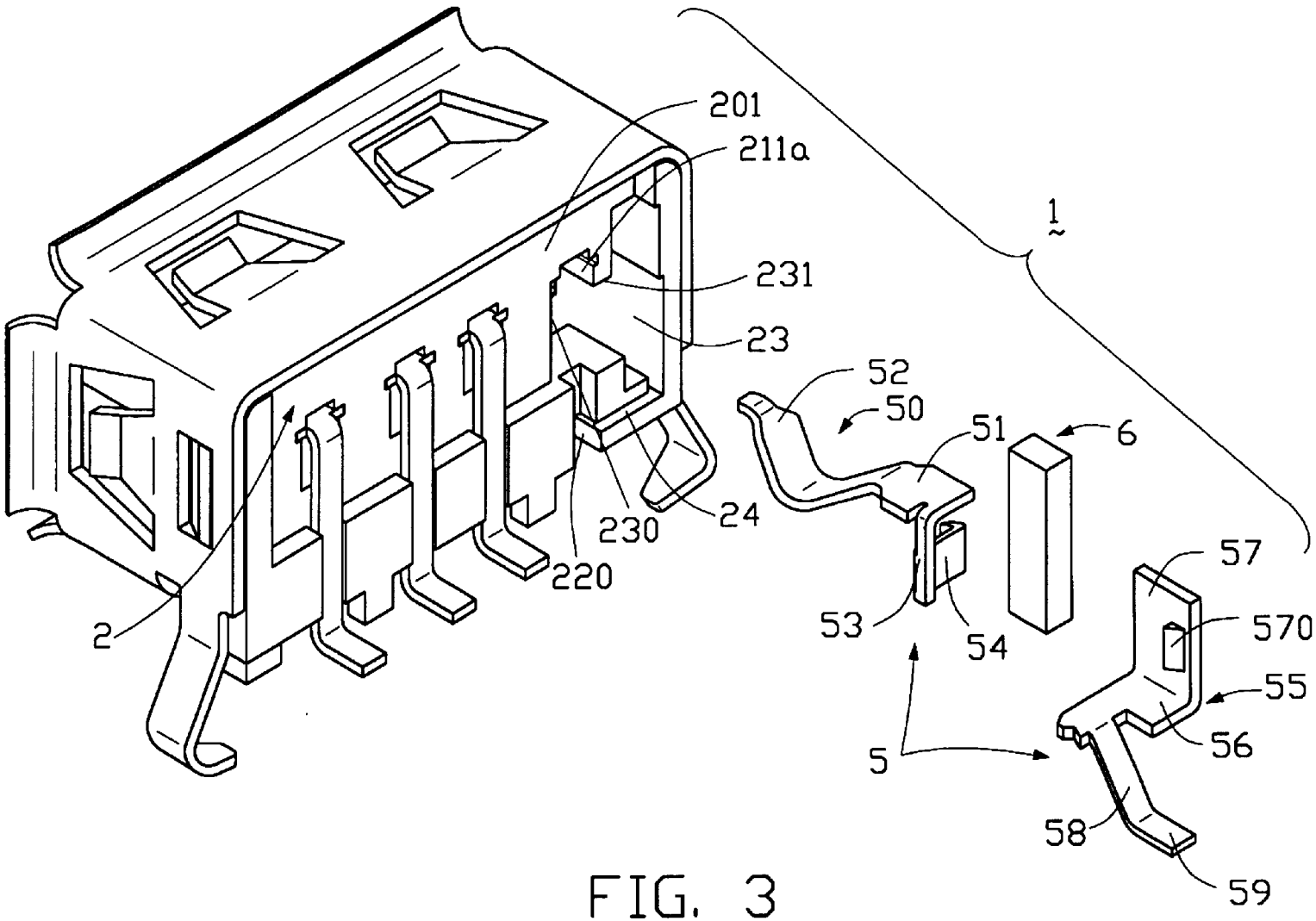
FIGS. 3 and 4 are schematic views illustrating how the polyswitch is assembled to the connector.
Figure 4:
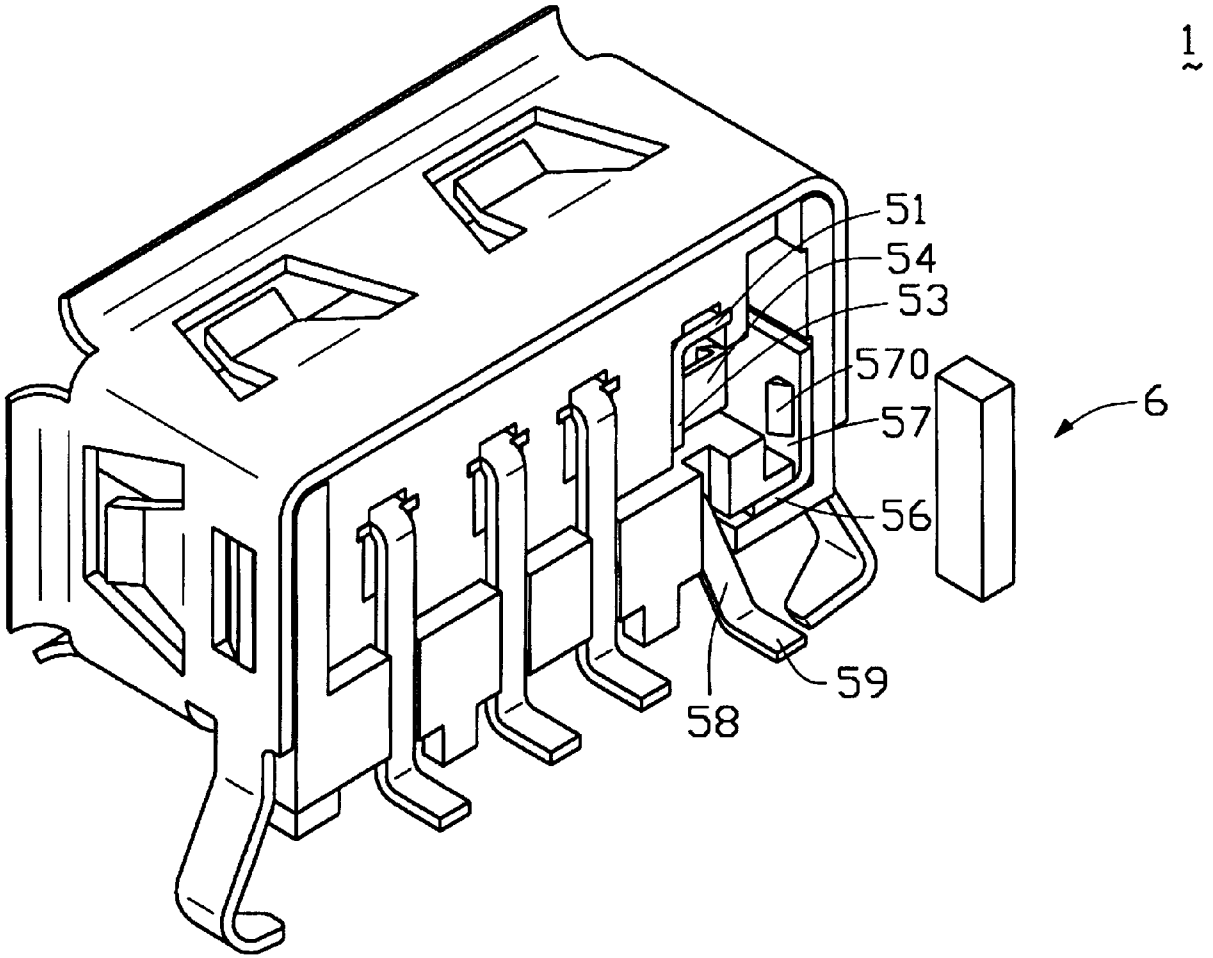

Referring to FIGS. 3 and 4 in conjunction with FIG. 1, when assembling the polyswitch 6 to the insulative body 2, the first contact member 50 is received in the opening 211*a* of the insulative body 2 with the first contact section 52 thereof entering into the corresponding through hole 213 for mating with the corresponding mating contact of the complementary connector. The first retention section 51 interferentially engages with the opening 211*a* whereby the first abutment section 53 abuts against an inner side surface 230 of the cavity 23 and the tongue section 54 abuts against an inner upper surface 231 of the cavity 23. Thus, the first contact member 50 is securely retained in the insulative body 2. The second contact member 55 is then assembled to the insulative body 2 by inserting the second retention section 56 thereof into the slot 24 whereby the second abutment section 57 abuts against an inner side surface (not labeled) of the cavity 23 and the second supporting section 58 is retained in the corresponding groove 220. The second solder section 59 is soldered to the corresponding solder pad on the printed circuit board. The polyswitch 6 is fully inserted into the cavity 23 whereby the tongue section 54 of the first contact member 50 abuts against a side surface thereof and the second abutment section 57 of the second contact member 55 abuts against an opposite side surface thereof. A rearward movement of the polyswitch 6 is prevented by the projection 570 of the second contact member 55. Thus, the polyswitch 6 is securely sandwiched between the first and second contact members 50, 55.

When a current passing through the first contact member 50 of the contact 5 due to connection with the complementary connector is within the rated operational current of the electronic system, temperature associated with the current is lower than the critical temperature of the polyswitch 6. In such a case, the polyswitch 6 acts as a conductor and allows the current to pass through the second contact member 55 soldered to the circuit board thereby forming a closed circuit. When the current passing through the first contact member 50 exceeds the rated operational current of the electronic system, the temperature associated with the current is higher than the critical temperature of the polyswitch 6. In such a case, the polyswitch 6 acts as an insulator whereby the current is switched off to obviate damage to the electronic system caused by overheating.

In addition, the polyswitch 6 is securely retained in the connector 1 by being sandwiched between the first and second contact members 50, 55 with only a slight modification to the original design of the connector 1. In other words, the polyswitch 6 utilizes an unused portion of the original connector 1 to implement the additional specific function, i.e., excessive current protection with only slight modification to the original design thereof, thereby significantly reducing the occupied space on the mother board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for connecting a complementary connector with a printed circuit board on which the connector is mounted, comprising:

an insulative body defining a plurality of contact receiving passageways;

a plurality of contacts received in corresponding contact receiving passageways of the insulative body, one of the contacts consisting of a first contact member received in a contact receiving passageway of the insulative body for mating with a mating contact of the complementary connector and a second contact member retained in the insulative body for being soldered to the circuit board, said one of the contacts having a shape similar to the rest of the contacts; and a polyswitch contacting the first and second contact members for controlling a current flow between the mating contact of the complementary connector and the circuit board;

wherein the polyswitch is sandwiched between the first and the second contact members, whereby the polyswitch is retentively retained in the insulative body by the first and the second contact members.

2. The electrical connector as described in claim 1, wherein the polyswitch is made from a polymer composition containing polymer materials of high molecular weight, the polyswitch acting as a conductor under a normal temperature condition and acting as an insulator under a given high temperature condition, the polyswitch having a critical temperature which is adjustable by changing the composition thereof.

3. The electrical connector as described in claim 1, wherein the first contact member comprises a first retention section retained in the insulative body, a first contact section forwardly extending from the first retention section for mating with the mating contact of the complementary connector, a first abutment section downwardly extending from the first retention section for abutting against an inner side surface of the corresponding passageway, and a tongue section perpendicularly extending from the first abutment section for abutting against a side surface of the polyswitch.

4. The electrical connector as described in claim 3, wherein the second contact member comprises a second retention section, a second abutment section upwardly extending from the second retention section for abutting against an opposite side surface of the polyswitch, a supporting section downwardly extending from the second retention section, and a solder section for being soldered to the circuit board.

5. The electrical connector as described in claim 4, wherein the second abutment section of the second contact member comprises a projection for preventing displacement of the polyswitch relative to the insulative body.

6. The electrical connector as described in claim 1, wherein the insulative body comprises a mating surface for mating with the complementary connector and an opposite assembly surface having a cavity formed therein for receiving both the polyswitch and a portion of the second contact member.

7. The electrical connector as described in claim 6, wherein the insulative body comprises a plurality of protrusions extending from the assembly surface and a groove defined between each adjacent pair of protrusions, the groove adjacent to the cavity being adapted for receiving the supporting section of the second contact member, the protrusion proximate the cavity being partially cut away to form a portion of the cavity and having a horizontal slot formed therein in communication with both the cavity and the adjacent groove for receiving the second retention section of the second contact member.

* * * * *